US006578339B1

(12) United States Patent
McGinnis

(10) Patent No.: US 6,578,339 B1
(45) Date of Patent: Jun. 17, 2003

(54) SECTIONAL TOWER WITH INTERMEDIATE LEGS

(76) Inventor: Henry J. McGinnis, 7241 Martha La., Fort Worth, TX (US) 76112

( * ) Notice: Subject to any disclaimer, the term of this patent is extended or adjusted under 35 U.S.C. 154(b) by 0 days.

(21) Appl. No.: 09/822,964

(22) Filed: Mar. 30, 2001

Related U.S. Application Data

(60) Provisional application No. 60/193,625, filed on Mar. 31, 2000.

(51) Int. Cl.[7] ..... E04H 12/00

(52) U.S. Cl. ..... 52/651.01; 52/651.02; 52/651.05; 52/651.06; 52/651.07; 52/645; 52/646; 52/651.1

(58) Field of Search ..... 52/651.01, 651.02, 52/651.05, 651.06, 651.07, 645, 646, 651.1; 403/335, 336, 337

(56) References Cited

U.S. PATENT DOCUMENTS

| | | | | | |
|---|---|---|---|---|---|
| 555,799 | A | * | 3/1896 | Barnard | 52/645 |
| RE12,842 | E | * | 8/1908 | Noyes | 52/646 |
| 1,935,095 | A | * | 11/1933 | Lewis | 52/651.06 |
| 2,740,504 | A | * | 4/1956 | Bailey | 52/646 |
| 2,804,950 | A | * | 9/1957 | Leslie, Jr. | 52/646 |
| 3,447,276 | A | * | 6/1969 | Svensson et al. | 52/651.01 |
| 4,050,214 | A | | 9/1977 | Johnson | |
| 4,063,426 | A | | 12/1977 | Hansen | |
| 4,231,200 | A | | 11/1980 | Henderson | |
| 4,295,317 | A | | 10/1981 | Van Tielen | |
| 4,377,812 | A | | 3/1983 | Goebel et al. | |
| 4,694,630 | A | * | 9/1987 | McGinnis | 52/649 |
| 5,197,253 | A | | 3/1993 | Johnson | |
| 5,450,695 | A | | 9/1995 | Desai | |
| 5,480,265 | A | | 1/1996 | Marshall et al. | |
| 5,490,364 | A | | 2/1996 | Desai et al. | |

* cited by examiner

*Primary Examiner*—Carl D. Friedman
*Assistant Examiner*—Nahid Amiri
(74) *Attorney, Agent, or Firm*—Bracewell & Patterson, L.L.P.

(57) ABSTRACT

A tower and a method of constructing a tower. The tower has three first support members which are made up of sections. Each section has an outside leg and two inside legs, laced together in a triangular cross section. The upper end of each inside leg is attached to the upper end of one of the other inside legs. Sections are joined together to form support members. Second support members are joined on top of the first support members. The desired height of the tower is achieved by adding other support members on top of the second support members. The last member to be placed on top is the upper member. An upper member, having three legs, laced together to form a triangular cross section, is erected on top of the support members, so that the legs of the upper member extend upward from the outside legs of the support members.

17 Claims, 3 Drawing Sheets

SECTIONAL TOWER WITH INTERMEDIATE LEGS

CROSS REFERENCE TO RELATED APPLICATION

This application claims priority of U.S. Provisional Application 60/193,625 filed Mar. 31, 2000.

BACKGROUND OF THE INVENTION

Field of the Invention

This invention relates in general to the field of towers and methods of constructing towers. In particular, the invention relates to self-supporting towers and methods of constructing such towers.

In the past, self-supporting towers are assembled piece-by-piece at the site. Skilled iron workers fasten the various legs and lattices together, generally at overlapping joints. Erecting such a tower is time consuming and requires extensive use of skilled workers and a crane.

SUMMARY OF THE INVENTION

The tower of the invention is pre-assembled in section, then shipped to a site for erection. First support members of selected length are placed upon the bases. Second support members are made up in sections so that the length of the tower can vary, and for ease of transportation. The tower has an upper member erected on top of the support members or trusses. The second support members are placed on top of first support members.

Each of the sections has an outside leg and two inside legs. The sections are connected in a vertical manner by flanges that mate on the ends of each section. The sections are connected to form a support member, either a first or second support member. The three first support members are connected together by attaching the top of each adjacent inside leg to the top of an adjacent inside leg on one of the other first support members. Each pair of inside legs may also be attached at an intermediate point, to form a window lower juncture. Second support members will be joined to the three first support members from a vertical direction utilizing flange connections more fully explained within. Additional support members will be constructed from sections to a desired height for the tower structure with an upper member being placed on the top. The upper member, which also has three legs, is then laced together to form a triangular cross section. The upper member is erected on top of the three support members, so that the three legs of the upper member extend upward from the three outside legs of the support members.

BRIEF DESCRIPTION OF THE PREFERRED EMBODIMENT

Figure 1A:
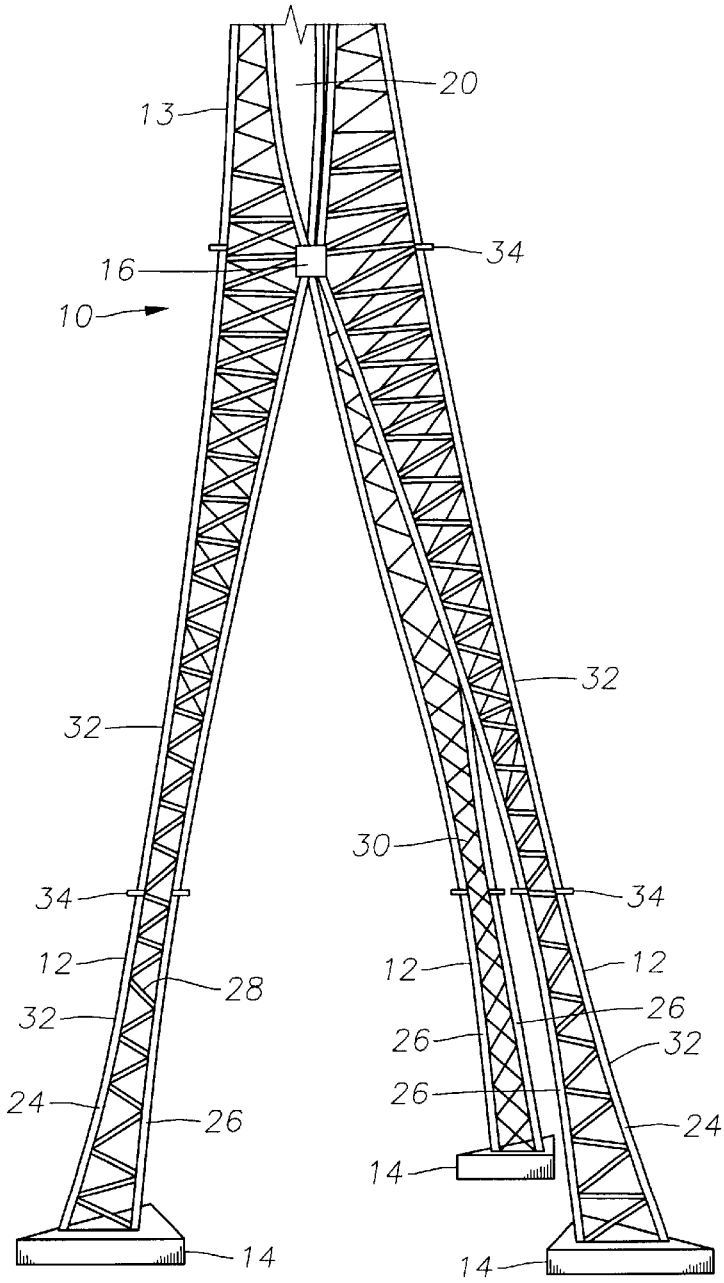
FIG. 1A is a perspective view of the lower portion of a tower constructed in accordance with this invention.
Figure 1B:
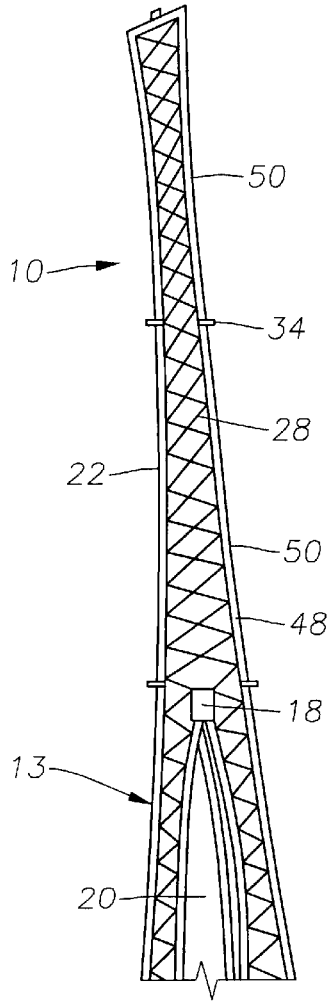
FIG. 1B is a perspective view of the upper portion of a tower constructed in accordance with this invention.

Referring first to FIGS. 1A and 1B, a tower 10 constructed in accordance with this invention has a plurality of sections

32 forming first support members 12, preferably three, mounted on and extending upward from corresponding bases 14. First support members 12 from horizontally adjacent sections 32 meet in at least a plane and preferably in two points, in at least one window lower juncture 16. Second support members 13 meet in at least a plane and preferably in two points in at least one window upper juncture 18. Lower juncture 16 and upper juncture 18 form a window 20. In taller towers 10, additional other sections 32 would meet at multiple window lower junctures 16, forming additional windows 20 and an upper juncture 18 would be positioned at the top of the uppermost window 20. A single upper member 22 is mounted on top of second support members 13 and extends upward. Additionally, in some applications it is possible to omit a single upper member 22, and instead have other windows 20 in a back to back configuration (not shown) thereby having a structure that consists only of windows 20.

Each support member 12, 13 is made up of one or more sections 32, each section being a truss having an outside leg 24 and two inside legs 26 which form generally the indices of a triangle. Lacing members 28 secure each inside leg 26 to outside leg 24 in a zig-zag type pattern. The two inside legs 26 are tied together by diagonals 30 in a cross type pattern. In some cases diagonals 30 may be augmented by horizontal struts (not shown).

A plurality of first and second support members 12, 13 are constructed in multiple sections 32 sized for easy handling and also to conveniently fit on a conventional railway car, tractor trailer, or other desired transport method. Sections 32 are joined together by flanged connectors 34 positioned at mating ends or surfaces of each section 32. First support members 12 are joined to second support members 13.

Figure 2:
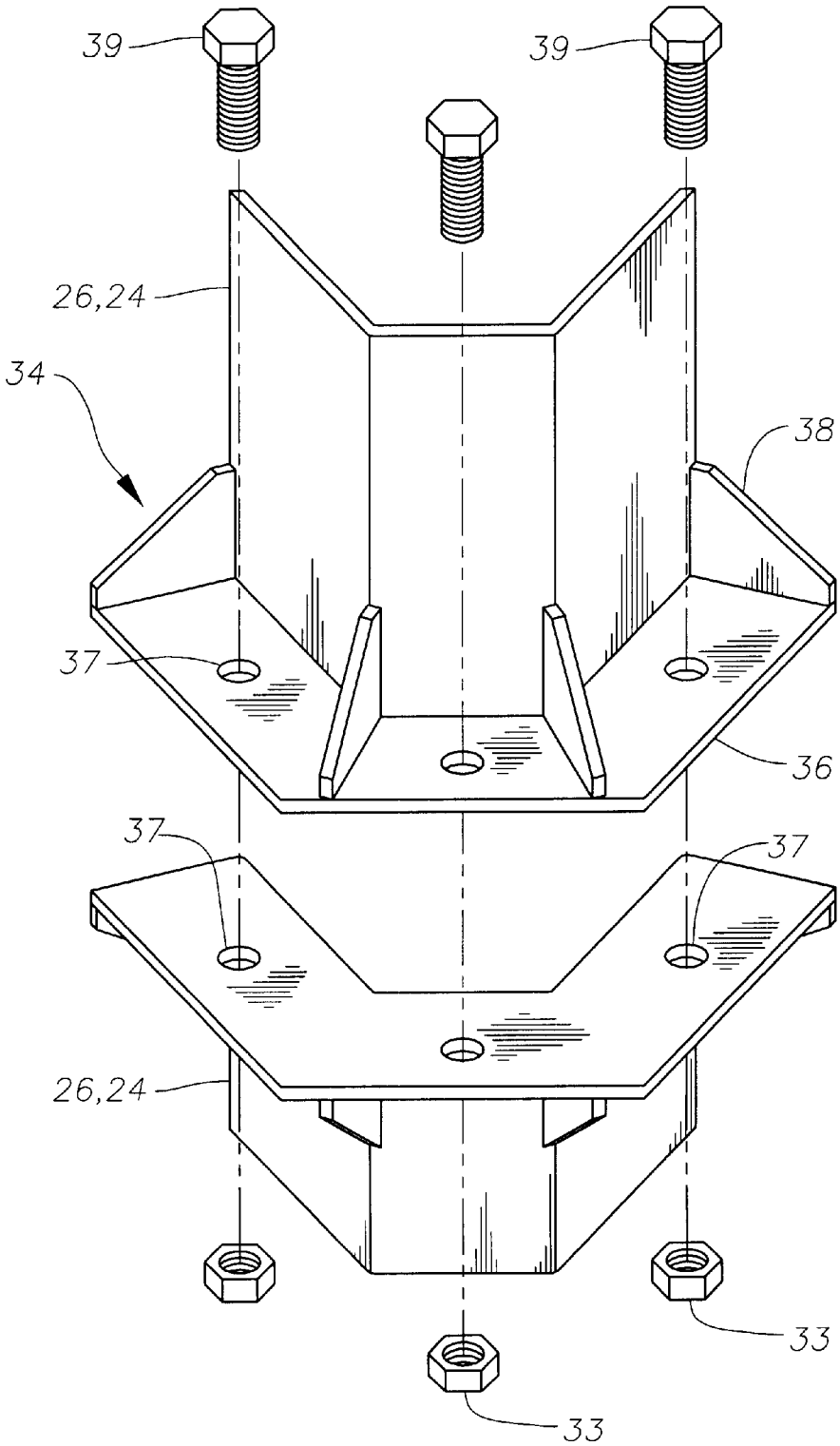
FIG. 2 is a perspective detail of the flanged connector of a tower constructed in accordance with this invention.

Referring to FIG. 2, legs 24, 26 have a generally C-shaped cross section. Flanged connectors 34 have a flange portion 36 joined about the C-shaped perimeter of a leg 24, 26. Flange portion 36 extends radially outward and has a gusset 38 extending axially and further joining and stiffening the leg 24, 26 and flange 36 interface. Flanged connectors 34 of one section 32 are bolted to the flanged connectors 34 of other sections 32 to form a complete support member 12. As is shown in FIG. 2, each flange portion 36 has a hole 37 for accepting a bolt 39 secured by a nut 33. It should be clear that a rivet or screw or other fastener may replace bolt 39, and if that occurs, the appropriate mating part to secure the connection will be employed. The number of sections 32 is determined by the desired section 32 length and the total height of tower 10. Alternatively, it is possible to have legs 24, 26 that do not have flange portion 36. These instead utilize a lap or butt splice (not shown) for fastening the legs 24, 26 together using metal support plates (not shown) that attach at the desired location of adjacent legs to secure one leg to another by several bolt 39 and nut 33 connections. The metal support plates can be attached on the inside and outside of the legs 24, 26.

Figure 3:
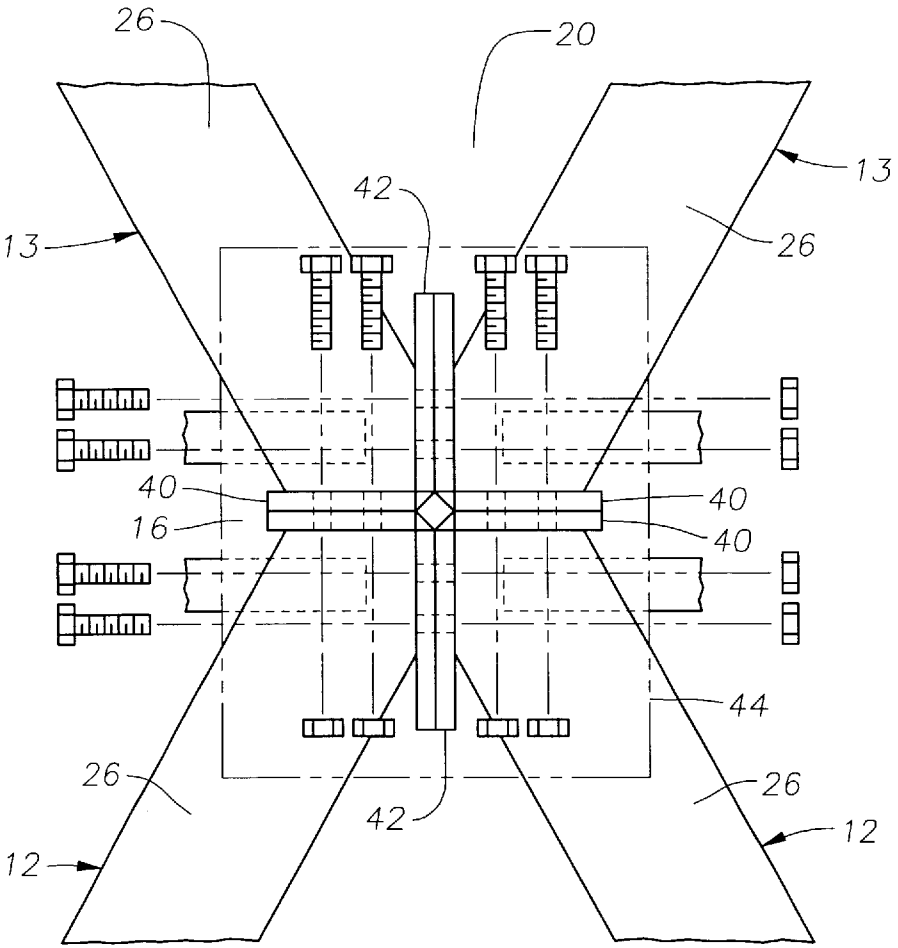
FIG. 3 is a side view detail of a lower window juncture of a tower constructed in accordance with this invention.

An inner leg 26 of one support member 12 joins with an inner leg 26 of another adjacent support member 12 at a window lower juncture 16 (FIG. 1A). The tower 10 of FIG. 1A has three window junctures 16, one on each side. As seen in FIG. 3, window lower juncture 16 has horizontal end plates 40 joined to legs 26 horizontally and vertical end plates 42 joined to legs 26 vertically. Horizontal end plates 40 of laterally adjacent sections 32 are bolted together, and vertical end plates 42 of vertically adjacent sections 32 are bolted together. Again, while bolting is envisioned, other suitable fastening means that provide quick and easy assembly are acceptable. A vertical cover plate 44 is bolted over the juncture. Outer legs 24 are connected as above with flanged connectors 34. If tower 10 has multiple windows 20, a window juncture 16 is used at the bottom of each window 20.

Figure 4:
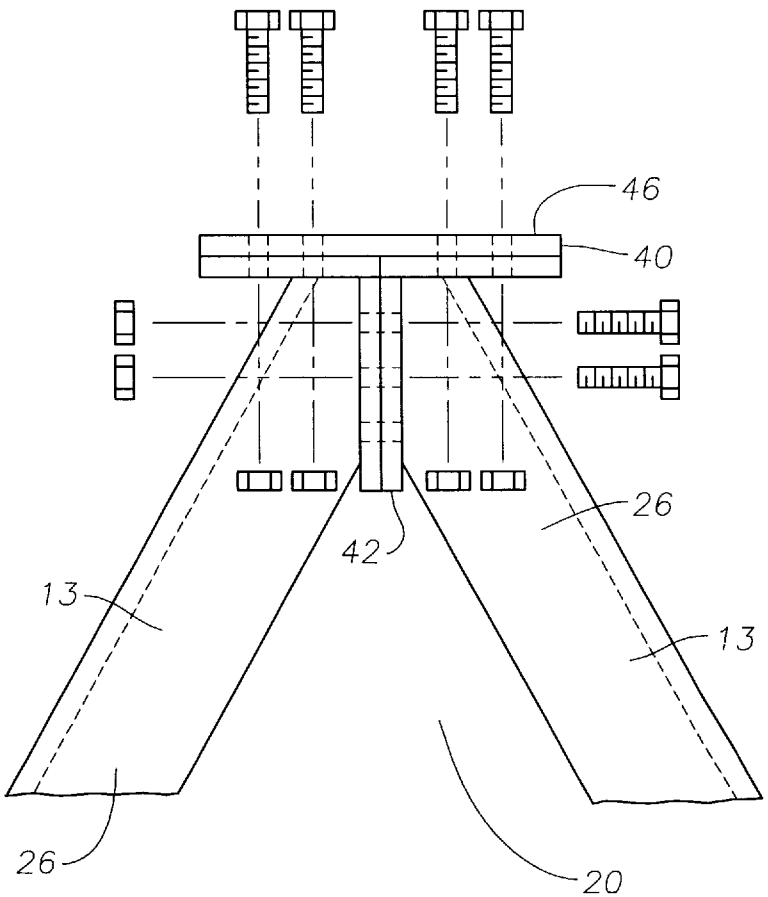
FIG. 4 is a side view detail of an upper juncture of a tower constructed in accordance with this invention.

Support members 13 terminate at the top of the uppermost window 20 and at upper juncture 18 (FIG. 1B). Referring to FIG. 4, upper juncture 18 has horizontal end plates 40 and vertical end plates 42 joined to inner legs 26. Inner legs 26 of laterally adjacent sections 32 are bolted together at horizontal end plates 40, and a cap plate 46 is bolted over vertical end plates 42.

Referring again to FIG. 1B, upper member 22 has three legs 48 forming the indices of a triangle and joined by lacing members 28. Like support members 12,13 upper member 22 is constructed in sections 50. The length and number of sections 50 vary with the requirements for each tower 10. Each section 50 is joined at legs 48 by flanged connectors 34, and upper member 22 is joined to outer legs 24 of support members 12 by flanged connectors 34.

In use, support member sections 32 and upper member sections 50 can be preassembled off site and transported to the erection site. Preferably each section 32, 50 is no longer than 50–60 feet so that they can be transported by truck or rail. Bases 14 are positioned in the ground and support sections 32 are secured thereto. Preferably, each support section 32 will be self supporting once secured to base 14. Although not completely vertical, the upper end of each section 32 is canterlevered supported by its lower end. Support sections 32 are joined to preceding support sections 32 at flanged connectors 34 to form each support member 12. In the preferred embodiment, there are two sections 32 in each first support member 12. Each first support member 12 will be self supporting. Support members 13 are joined at window junctures 16 and upper junctures 18. Upper member sections 50 are joined to support members 13 and further upper sections 50 are joined to preceding upper sections 50 to form upper member 22.

This invention has several advantages over the prior art. First, it is easy to assemble modular components 32 into larger units 12,13 that are pre-assembled offsite and does not require skilled workers. This translates into a cost advantage during manufacturing and assembly on site. Second because of its modular design, economies of scale and increased quality can be achieved in manufacturing. Furthermore, on site assembly is facilitated by use of flanges 34 on each leg 24, 26 that are joined by fasteners 39. This allows for faster assembly than welding.

While the invention has been shown in only one of its forms, it should be apparent to those skilled in the art that it is not so limited, but is susceptible to various changes without departing from the scope of the invention.

I claim:

1. A tower comprising:

at least three first support members, each support member having at least three legs interconnected by lattices, each first support member being fixedly mounted on and extending upward from a corresponding base;

each adjacent first support member meeting in at least one plane distal from each corresponding base, thereby forming a window lower juncture; and at least three second support members which are each fixedly mated on top of a surface of a corresponding first support member, each adjacent second support member meeting in at least one plane distal from the surface thereby forming a window upper juncture;

each of the first and second support members having an upper and a lower section;

a transverse flange that extends radially outward from each leg, one of the transverse flanges located at an upper end of each leg of each lower section and abutting with the transverse flange of one of the legs of each upper section; and a plurality of fasteners that secure the abutting flanges together.

2. A tower according to claim 1 wherein each of said legs has a c-shape with the flange extending radially outward from the leg.

3. A tower according to claim 1 wherein each first support member has an inside leg and two outside legs and the window lower junction comprises vertical plates connected between the inside legs.

4. A tower according to claim 1 wherein each transverse flange has a plurality of axially extending gussets joined about a perimeter of each of said legs.

5. A tower according to claim 1 wherein each of the first support members has an inside leg and two outside legs and wherein the window lower juncture comprises:

a plurality of horizontal end plates joining the inside legs of the first support members to the second support members;

a plurality of vertical end plates joining the inside legs to each other; and a vertical cover plate covering said window lower juncture.

6. A tower according to claim 1 wherein a single upper member is fixedly mounted on top of said at least three second support members.

7. A tower comprising:

at least three first support members, each first support member having at least three legs interconnected by lattices, each first support member being fixedly mounted on and extending upward from a corresponding base;

each adjacent first support member gradually curving upwards to meet adjacent first support members, thereby forming a window lower juncture;

at least three second support members which are each fixedly mated on top of a surface of a corresponding first support member, each adjacent second support member gradually curving upwards to meet adjacent second support members, thereby forming a window upper juncture;

each of the first and second support members having upper and a lower sections;

a transverse flange that extends radially outward from each leg, one of the transverse flanges being located at an upper end of each leg of each lower section and abutting with the transverse flange of one of the legs of each upper section; and a plurality of fasteners that secure the abutting transverse flanges together.

8. A tower according to claim 7 wherein each of said legs has a c-shape with the transverse flange extending radially outward from the leg.

9. A tower according to claim 7 wherein each first support member has an inside leg and two outside legs and the window lower junction comprises vertical plates connected between the inside legs.

10. A tower according to claim 7 wherein each transverse flange has a plurality of axially extending gussets joined about a perimeter of each said leg.

11. A tower according to claim 7 wherein each of the first support members has an inside leg and two outside legs and wherein the window lower juncture comprises:

a plurality of horizontal end plates joining the inside legs of the first support members to the second support members;

a plurality of vertical end plates joining the inside legs to each other; and a vertical cover plate covering said window lower juncture.

12. A tower according to claim 7 wherein a single upper member is fixedly mounted on top of said at least two second support members.

13. A method for constructing a tower comprising the steps of:

providing a plurality of sections having legs connected together by lattices, preassembling the sections to a predetermined length;

transporting said preassembled sections to a site; then connecting a plurality of the preassembled sections together to form first support members, second support members, and an upper support member by abutting the ends of the legs of the preassembled sections to each other, wherein each said leg has a transverse flange on each end;

connecting said first support members to a base and then to one another;

connecting said second support members to said first support members; then connecting said upper support member to said second support members.

14. The method for constructing a tower as claimed in claim 13, wherein each of said legs has a c-shape and each of said flanges extends radially outward therefrom.

15. The method for constructing a tower as claimed in claim 13 wherein:

upper ends of the first support members engage each other to form a window lower junction;

each first support member has an inside leg and two outside legs; and the window lower junction comprises vertical plates connected between the inside legs.

16. The method for constructing a tower as claimed in claim 13 wherein each transverse flange has a plurality of axially extending gussets joined about a perimeter of each said leg.

17. A method for constructing a tower comprising the steps of:

providing a plurality of sections having legs connected together by lattices, preassembling the sections to a predetermined length;

transporting said preassembled sections to a site; then connecting a plurality of the preassembled sections together to form first support members, second support members, and an upper support member by abutting the ends of the legs of the preassembled sections together;

connecting said first support members to a base and then to one another to form a window lower juncture;

connecting said second support members to said first support members; then connecting said upper support member to said second support members; wherein each of the first support members has an inside leg and two outside legs and wherein the window lower juncture comprises:

a plurality of horizontal end plates joining the inside legs of the first support members to the second support members, a plurality of vertical end plates joining the inside legs to each other; and a vertical cover plate covering said window lower juncture.

* * * * *